US005297614A

United States Patent [19]

Bessho et al.

[11] Patent Number: 5,297,614

[45] Date of Patent: Mar. 29, 1994

[54] PROCESS FOR CONTINUOUS CASTING OF ULTRA LOW CARBON ALUMINUM KILLED STEEL

[75] Inventors: Nagayasu Bessho; Hisao Yamazaki; Tetusya Fujii, all of Chiba, Japan

[73] Assignee: Kawasaki Steel Corporation, Japan

[21] Appl. No.: 915,708

[22] PCT Filed: Nov. 27, 1991

[86] PCT No.: PCT/JP91/01625

§ 371 Date: Jul. 27, 1992

§ 102(e) Date: Jul. 27, 1992

[87] PCT Pub. No.: WO92/09387

PCT Pub. Date: Nov. 6, 1992

[30] Foreign Application Priority Data

Nov. 28, 1990 [JP] Japan ..... 2-322693

[51] Int. Cl.[5] ..... B22D 11/10

[52] U.S. Cl. ..... 164/488; 164/459

[58] Field of Search ..... 164/488, 489, 490, 459

[56] References Cited

FOREIGN PATENT DOCUMENTS 634844 11/1978 U.S.S.R. ..... 164/488

*Primary Examiner*—Kuang Y. Lin

*Attorney, Agent, or Firm*—Austin R. Miller

[57] ABSTRACT

A process for continuous casting of ultra low carbon aluminum killed steel, characterized in that the steel contains 6–20 ppm of calcium, less than 0.01 wt % of sulfur, and less than 30 ppm of oxygen, the molten steel superheat temperature in the tundish is higher than 16° C., and the average flow rate of molten steel is greater than 1.2 m/sec in the straight part of the nozzle. This process prevents rusting and eliminates the necessity of blowing a gas into the immersion nozzle and hence prevents the swelling of cold rolled sheets.

2 Claims, 8 Drawing Sheets

PROCESS FOR CONTINUOUS CASTING OF ULTRA LOW CARBON ALUMINUM KILLED STEEL

TECHNICAL FIELD

The present invention relates to a process for continuous casting of ultra low carbon aluminum killed steel.

BACKGROUND ART

First of all, a process for continuous casting is outlined with reference to FIG. 1 which is a schematic diagram showing the upper part of a continuous casting machine into which molten steel is poured.

A problem involved in the conventional process of continuous casting of ultra low carbon aluminum killed steel is the clogging of the immersion nozzle 1 with $Al_2O_3$ sticking thereto. Common practice to prevent the clogging is to blow an argon gas into the immersion nozzle 1 from the upper nozzle 2 or sliding nozzle 3. A disadvantage of this practice is that the argon gas becomes bubbles which are entrapped in the solidified shell during the step of continuous casting. The entrapped bubbles expand when heated during the step of annealing after rolling, swelling the surface of a cold rolled sheet.

There are three methods for preventing the clogging of the immersion nozzle without blowing an argon gas. They involve the addition of calcium to the molten steel being cast so that calcium changes $Al_2O_3$ into a composite compound of $CaO—Al_2O_3$ having a lower melting point, as disclosed in Japanese Patent Laid-open Nos. 99761/1989 (1), 276756/1986 (2), and 1457/1986 (3). According to the first disclosure, the tundish is provided with a refractory cylinder within 1 meter from the center of the tundish nozzle, with the lower end thereof immersion in the molten steel, and calcium is thrown into the cylinder in an amount equal to 5–20 ppm of the molten steel passing through the tundish nozzle. According to the second disclosure, calcium or a calcium alloy is added to the melt of aluminum killed steel containing less than 0.015 wt % of carbon, such that metallic calcium in an amount of 2–40 ppm remains to form $CaO—Al_2O_3$ compounds in the steel. According to the third disclosure, an aluminum killed steel or aluminum-silicon killed steel containing more than 0.05 wt % titanium and more than 0.01 wt % aluminum is continuously cast after the composition has been adjusted such that the molten steel in the tundish contains 0.001–0.005 wt % calcium.

All the methods in the above-mentioned three disclosures have the following disadvantages.

(a) The resulting cold rolled steel sheet is subject to rusting depending on the chemical composition of steel (or the content of calcium and sulfur in steel) which determines the conditions of calcium addition.

(b) The nozzle clogging may occur depending on the chemical composition of steel melt (such as content of calcium and oxygen in steel) or the continuous casting conditions, which prevents successive casting of many heats with one immersion nozzle.

Moreover, in the case where calcium is added but the blowing of argon gas into the immersion nozzle 1 is stopped, there exists no rising flow of molten steel induced by the buoyancy of gas in the mold 5. This results in the solidifying on the surface of the molten steel in the mold, which in turn leads to a high breakout ratio and the surface and inner defects of slabs cast. Also, in the case where the supply of argon gas is stopped, there exists no gas, which functions as a heat insulator, between the flow of molten steel and the inside of the immersion nozzle 1. This causes the molten steel to solidify on the inside of the nozzle above the surface of the molten steel in the mold. This in turn causes the nozzle clogging with solidified steel 6.

Incidentally, the ultra low carbon aluminum killed steel in the present invention denotes a steel which contains, in the steel melting step, less than 30 ppm of carbon and less than 40 ppm of oxygen (as the result of deoxidization mostly by aluminum).

DISCLOSURE OF THE INVENTION

Figure 1:
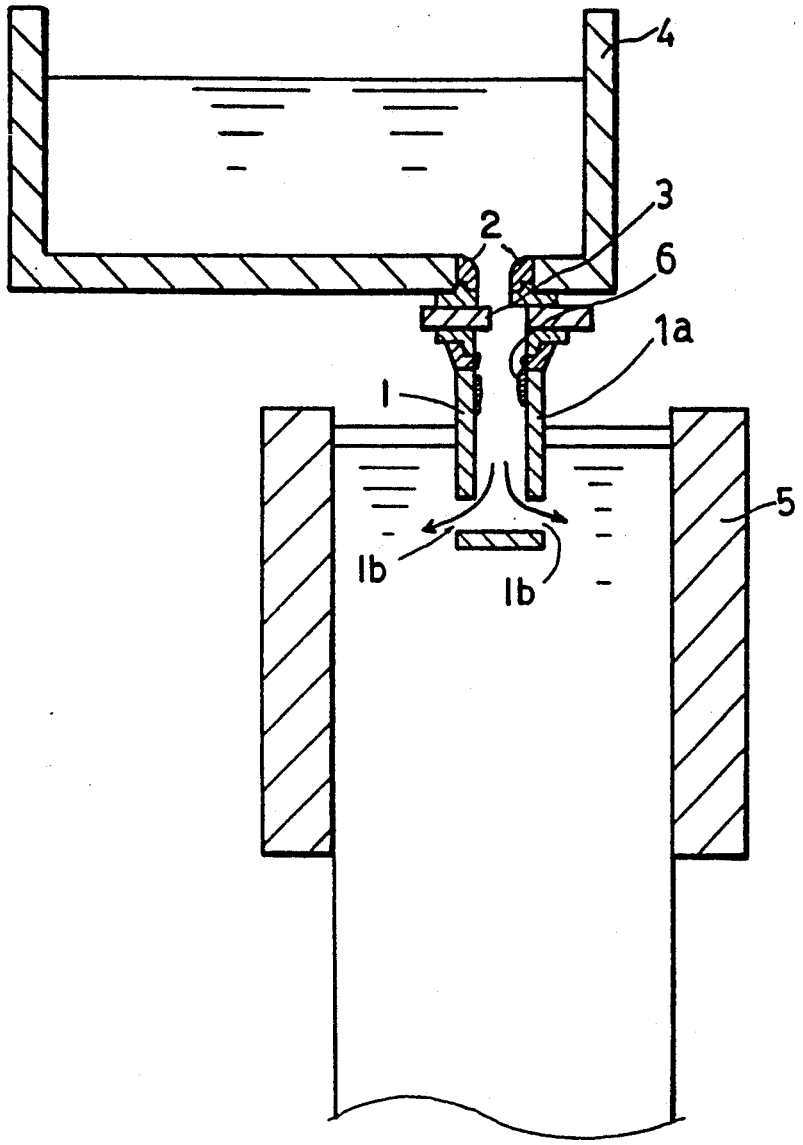
FIG. 1 PRIOR ART
FIG. 1 is a schematic diagram showing the process for continuous casting and also showing the sticking of solidified iron to the inside of the immersion nozzle which occurs when the blowing of gas into the immersion nozzle is stopped.

The present invention was completed to address the above-mentioned problems involved in the prior art technology. It is an object of the present invention to provide a process for stable, continuous casting of ultra low carbon aluminum killed steel, said process obviating the necessity of blowing an argon gas and preventing the cold rolled steel sheet from swelling and rusting.

The present invention is embodied in a process for continuous casting of ultra low carbon aluminum killed steel, characterized in that (a) the steel contains 6–20 ppm of calcium, less than 0.01 wt % of sulfur, and less than 30 ppm of oxygen, (b) the molten steel overheating temperature ($\Delta T$) in the tundish is higher than 16° C., and (c) the average flow rate (v) of molten steel is greater than 1.2 m/sec in the straight part 1*a* of the nozzle.

The present inventors investigated the following three items in order to develop a process for stable, continuous casting which is accomplished by adding calcium to an ultra low carbon aluminum killed steel, thereby lowering the melting point of alumina impurities, without blowing an argon gas into the immersion nozzle 1, said continuous casting giving rise to a cold rolled sheet which is immune to swelling and rusting.

(A) A specific composition of molten steel which is required for the immersion nozzle to be free from clogging with alumina impurities when calcium is added to the molten steel to lower the melting point of alumina impurities but an argon gas is not blown into the immersion nozzle.

(B) A technique that meets the above-mentioned requirements to carry out stable continuous casting to produce high-quality slab cast.

(C) A specific composition of steel which protects cold rolled steel sheets from rusting. The investigation on these three items produced the following results.

(A) A specific composition of molten steel which permits the melting point of alumina impurities to be lowered by the addition of calcium to the molten steel and prevents the immersion nozzle from clogging in the absence of blowing gas.

The calcium content necessary for the melting point of alumina impurities to be lowered was studied on the basis of the following equation.

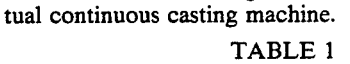

$$Ca + Al_2O_3 \rightarrow nCaO.Al_2O_3 + Al$$

The experiment was carried out under the conditions shown in Table 1. The content of calcium was increased from 0 ppm to 20 ppm so as to see the relationship between the calcium content in steel and the nozzle clogging that occurs when no gas is blown into the immersion nozzle during continuous casting by an actual continuous casting machine.

TABLE 1

Main experimental conditions preventing immersed nozzle from clogging

| | |
|---|---|
| Type of continuous casting machine | Curved-type continuous casting machine with 12 mR, 2-strands |
| Mold size | 220 mm (t) × 1500 mm (W) |
| Molten steel throughput | 3.5 t/min · strand |
| Superheat of molten steel in tundish (ΔT) | 20–26° C. |
| Immersion nozzle | Inside diameter of straight part: 70 mm<br>Two discharge spouts arranged horizontal, each 70 mm in diameter. |
| Diameter of sliding nozzle | 70 mm |
| weight of molten steel in ladle | 140 tons/charge |
| Composition of molten steel | C . . . 15–25 ppm<br>Si . . . tr.<br>Mn . . . 0.10–0.14 wt %<br>P . . . 0.006–0.008 wt %<br>Ti . . . 0.022–0.026 wt %<br>Al . . . 0.020–0.033 wt %<br>T · O . . . 15–24 ppm<br>S . . . 0.006–0.009 ppm<br>Ca . . . 0–20 ppm |

Figure 2:
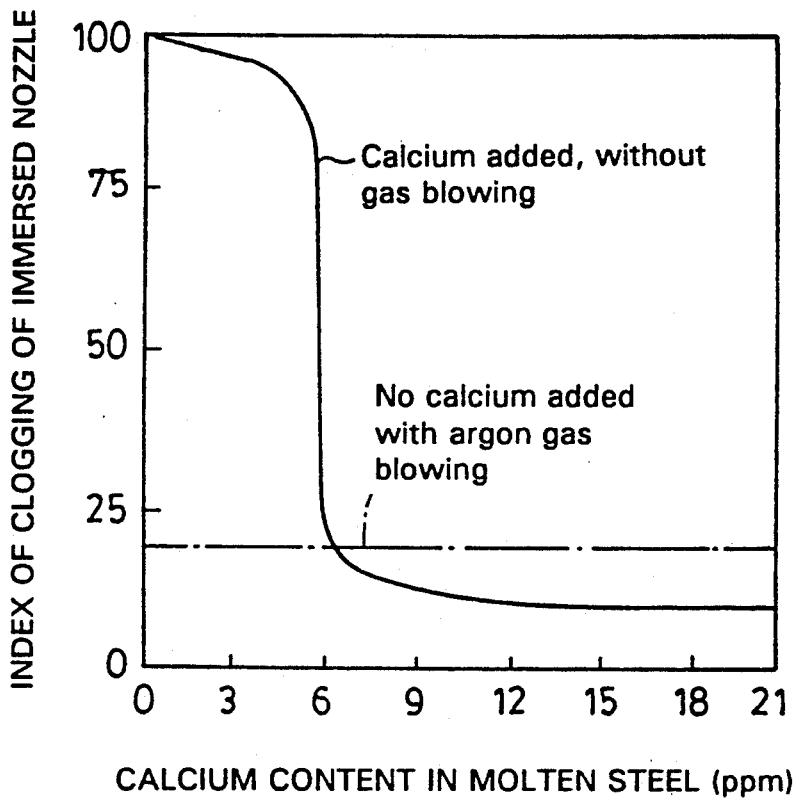
FIG. 2 is a graph showing the relationship between the index of clogging of the immersion nozzle and the calcium content in molten steel.

FIG. 2 shows the relationship between the content of calcium in molten steel and the degree of clogging of the immersion nozzle in the case when no argon gas is blown. In FIG. 2, the index of clogging is expressed in terms of the opening of the sliding nozzle (which is positioned above the immersion nozzle and is designed to control the amount of molten steel). The greater the value of index, the more serious the clogging. The index indicates the average value of the opening of sliding nozzles from the first to second heat.

It is noted from FIG. 2 that it is possible to prevent the nozzle clogging as effectively as in the case when an argon gas is blown into the nozzle, if the content of calcium is higher than 6 ppm. By contrast, severe nozzle clogging (which leads to the interruption of continuous casting) occurs when the content of calcium is equal to or lower than 6 ppm.

Experiment was continued on the clogging of the immersion nozzle, with the content of calcium varied in the range from 6 ppm to 20 ppm and no argon gas blown into the immersion nozzle.

Figure 3:
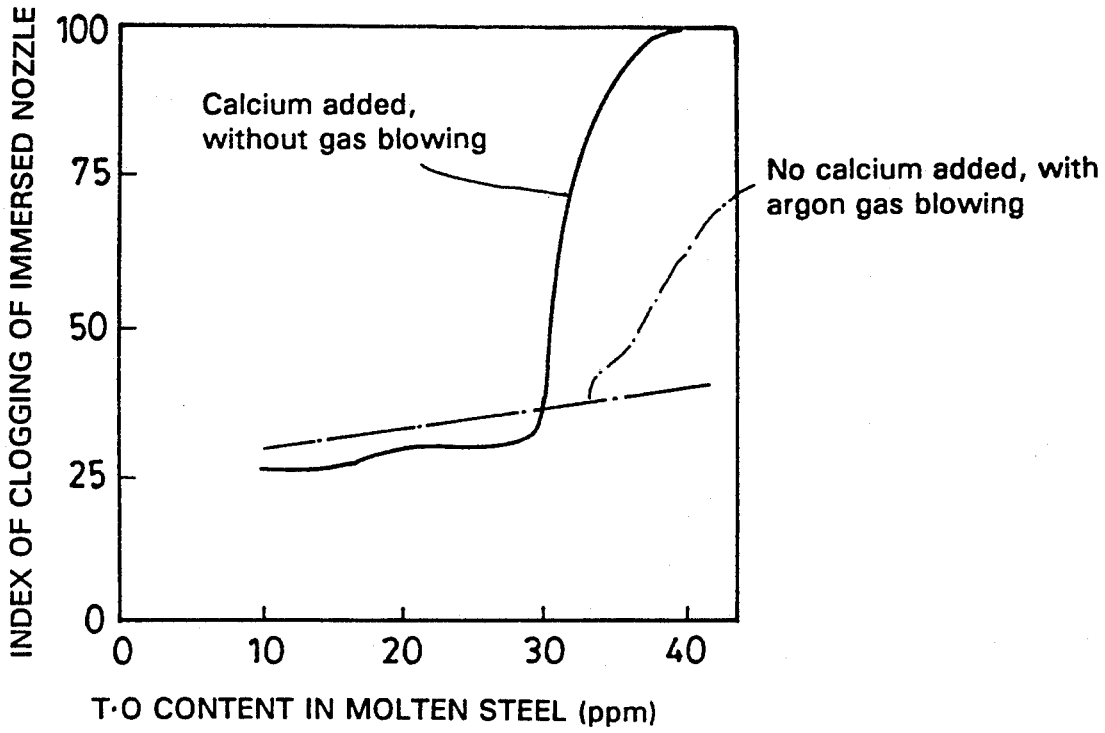
FIG. 3 is a graph showing the relationship between the index of clogging of the immersion nozzle and the T.O content in molten steel.

Experiment was carried out on the relationship between the index of clogging of the immersion nozzle and the T.O Total Oxygen content in steel over the range from 10 ppm to 40 ppm. The results are shown in FIG. 3. (The condition of this experiment is the same as that shown in Table 1 except for the calcium content and T.O content in the steel.)

In FIG. 3, the index of clogging of the immersion nozzle is based on the average opening of sliding nozzle during the casting of the third heat. It is noted that when the T.O content exceeds 30 ppm, the nozzle clogging becomes severe making impossible operation with three or more heats successively. The reason for this is that with the T.O content in excess of 30 ppm, calcium in an amount of from 6 ppm to 20 ppm is not enough to lower the melting point of alumina impurities and hence impurities stick to the immersion nozzle.

(B) Stabilizing the continuous operation and improving the slab quality in the absence of gas blowing into the immersion nozzle.

Study was made on the stability of operation and the quality of slab in the case of continuous casting which is performed without the blowing of gas into the immersion nozzle, with the conditions of the abovementioned item (A) satisfied. (Ca=6–20 ppm, T.O≦30 ppm).

Study was made on the relationship between the clogging of the immersion nozzle and the flow rate (v) of the molten steel in the straight part of the immersion nozzle or the molten steel superheat temperature (ΔT) in the tundish 4. (The flow rate (v) is defined as the volumetric flow rate of molten steel in the immersion nozzle divided by the cross sectional area of the straight part of the immersion nozzle.)

The molten steel superheat temperature (ΔT) is adjusted by (i) regulating the temperature of molten steel being tapped from the converter, (2) the use of Tundish heater, and (3) the heating of molten steel at the secondary refining process (heat induced by the oxidation of metallic aluminum added to molten steel).

Figure 4:
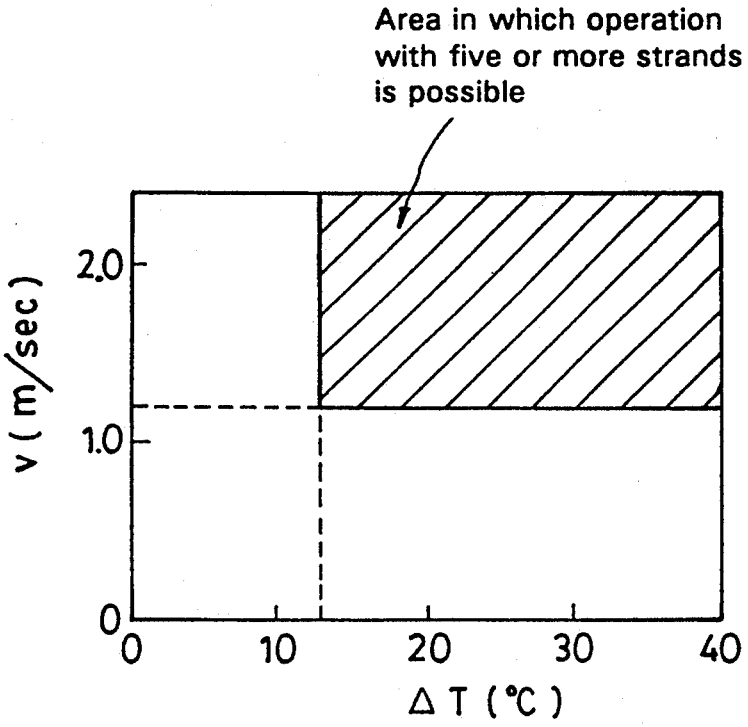
FIG. 4 is a diagram showing the relationship between the flow rate (v) and the $\Delta T$ which establish the area in which successive casting of five or more heats with one immersion nozzle is possible.

Other conditions remain the same as shown in Table 1. The results are shown in FIG. 4. Experiments were carried out with v in the range from 0.6 to 2.4 m/sec and ΔT in the range from 7° to 40° C. The hatched area in FIG. 4 represents the range in which five or more heats can be cast successively with one immersion nozzle. In this area, v≧1.2 m/sec and ΔT≧13° C. The clogging of the immersion nozzle in this case is not due to the sticking of inclusions to the discharge spout of the immersion nozzle but due to the heat extraction from the straight part 1*a* of the immersion nozzle, which causes the solidified iron 6 to grow on the inside of the straight part. In the case where an argon gas is blown into immersion nozzle, successive operation with five or more heats is possible even though v≧0.6 m/sec and ΔT≧7° C. In the case when no gas is blown into the immersion nozzle, no gas film is formed between the inside wall of the straight part of the immersion nozzle and the molten steel flowing through the nozzle. Hence, the heat insulation of molten steel by the gas film is not effected, with the result that molten steel solidifies and sticks to the inside of the straight part of the immersion nozzle. This is the cause of nozzle clogging.

To prevent the nozzle clogging and to enable successive operation with three or more heats, it is necessary that $v \geqq 1.2$ m/sec and $\Delta T \geqq 13°$ C.

In the absence of gas blown into the immersion nozzle, there will be no rising flow of molten steel induced by the buoyancy of gas in the mold. It follows, therefore, that the molten steel solidifies in the surface of the melt in the mold, resulting in entrapping mold powder into molten steel and the melting of mold powder becomes insufficient, resulting in the break-out.

To investigate the relationship between the occurrence of break-out and the $\Delta T$, continuous casting was carried out with the calcium content varied in the range from 6 ppm to 15 ppm and the $\Delta T$ varied in the range from 7° C. to 40° C., in the absence of gas blown into the immersion nozzle, with other conditions remaining the same as shown in Table 1. The results are shown in FIG. 5.

Figure 5:
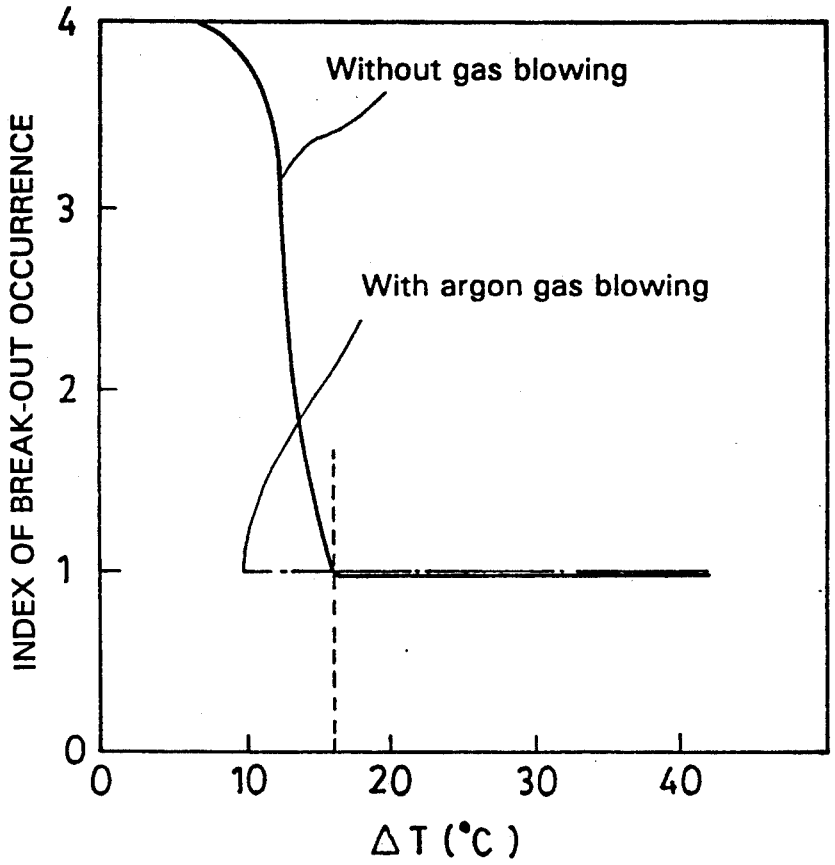
FIG. 5 is a diagram showing the relationship between the index of break-out occurrence and the $\Delta T$.

It is noted from FIG. 5 that in order to keep low the occurrence of break-out due to the insufficient melting of mold powder, it is necessary that $\Delta T \geqq 16°$ C. if no gas is blown into the immersion nozzle. It is also noted that if $\Delta T \geqq 16°$ C., it is possible to reduce the surface defects resulting from mold powder below one-third those which occur in the cold rolled steel sheet when casting is performed with the $\Delta T$ lower than 16° C.

It is concluded from the foregoing that the following conditions represented by the formulas (2) should be satisfied if ultra low carbon aluminum killed steel is to be produced by the addition of calcium in the absence of gas blown into the immersion nozzle, while preventing the clogging of immersion nozzle and the occurrence of break-out and minimizing the surface defects due to mold powder.

(a) $Ca \geqq 6$ ppm (b) $T.O \leqq 30$ ppm (c) $v \geqq 1.2$ m/sec (d) $\Delta T \geqq 16°$ C. (2)

(C) Study on the composition of steel to protect the cold rolled steel sheet from rusting.

Rusting test was performed on samples of cold rolled sheet of ultra low carbon steel which contains calcium. The samples of cold rolled steel sheets are of the two kinds shown below.

(a) Those which were obtained on an experimental scale by melting, ingot making, hot rolling, and cold rolling.

(b) Those which were obtained on a commercial production scale by continuous casting, hot rolling, and cold rolling.

The steel from which the cold rolled sheets (a) and (b) were produced has the composition as shown in Table 2 below.

TABLE 2

| Chemical compositions of steel used for rusting test | |
|---|---|
| C | 15–30 ppm |
| Si | tr. |
| Mn | 0.08–0.12 wt % |
| P | 0.007–0.011 wt % |
| Ti | 0.020–0.028 wt % |
| Al | 0.025–0.042 wt % |
| T · O | 18–23 ppm |
| Ca | 0 ppm and 6–30 ppm |
| S | 0.001–0.020 wt % |

The rusting test was performed on cold rolled steel sheets, with the calcium content kept at 0 ppm and varied in the range of 6–30 ppm and the sulfur content varied in the range of 0.001–0.020 wt %. For the rusting test, specimens were allowed to stand for 10 hours in a container in which the temperature was kept at 90°–95° C. and the humidity was kept at 90–95%, and the area of rust was measured.

The results of the rusting test suggest that rusting is due to a local cell which is formed by the following mechanism. Calcium converts $Al_2O_3$ into a composite compound of $CaO—Al_2O_3$ which has a lower melting point than $Al_2O_3$. This compound has CaS around it. CaS hydrolyzes and dissolves in water, thereby forming a local cell.

Figure 6:
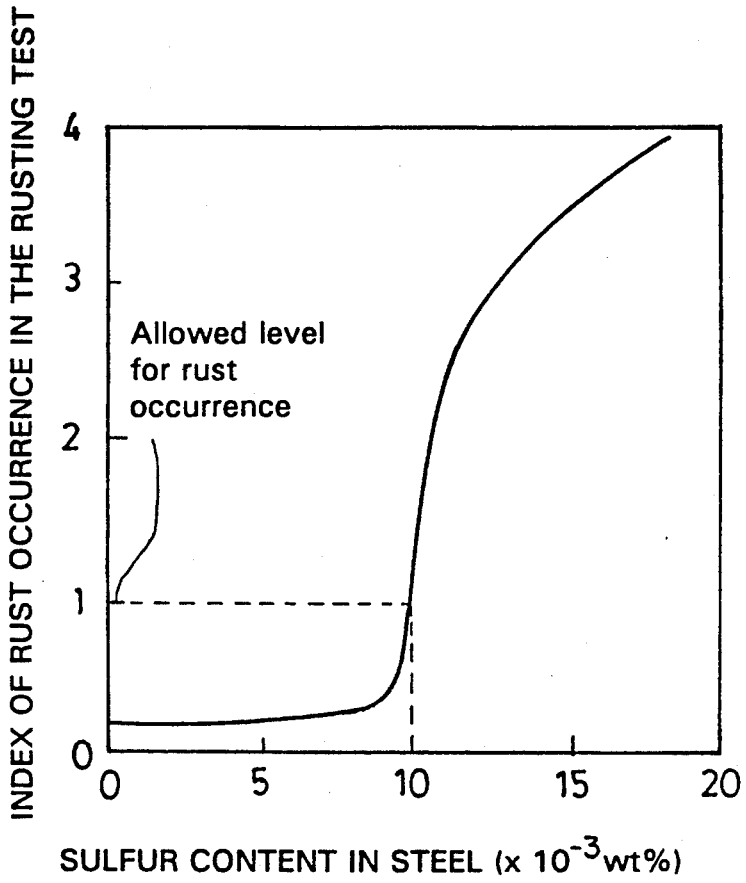
FIG. 6 is a diagram showing the relationship between the index of rust occurrence in the rusting test and the sulfur content in steel.
Figure 7:
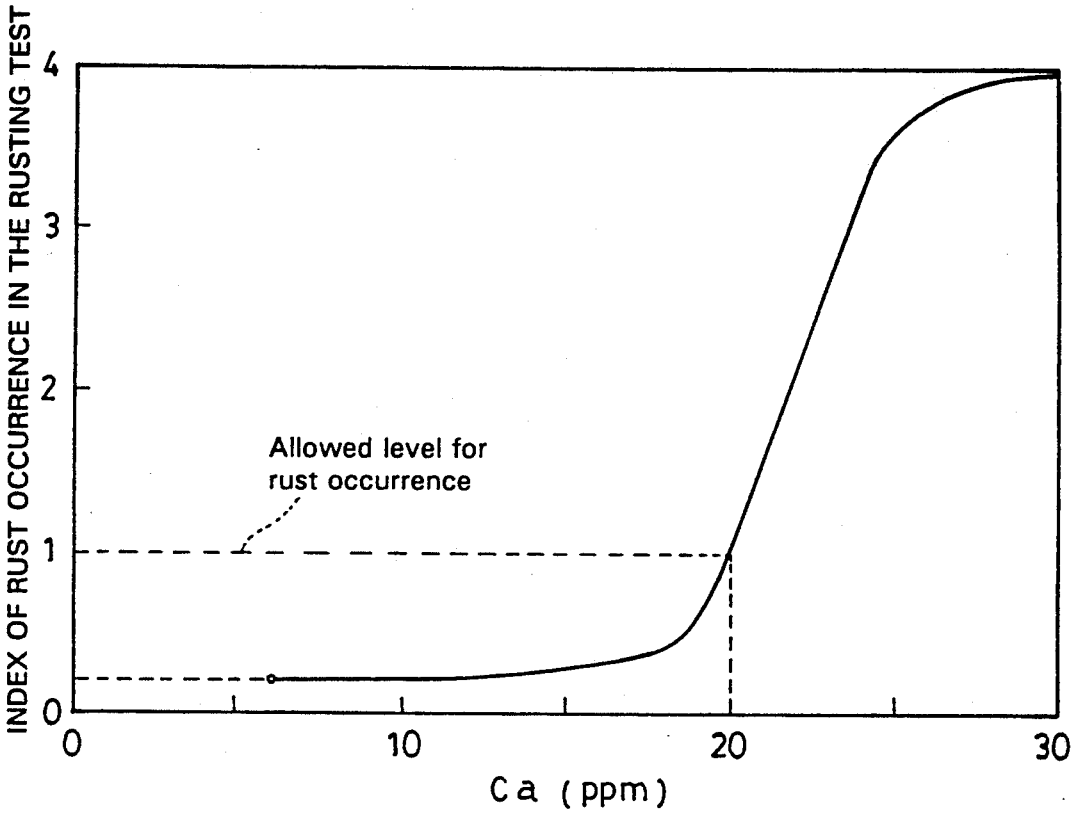
FIG. 7 is a diagram showing the relationship between the index of rust occurrence in the rusting test and the calcium content in steel.

The results of the rusting test are shown in FIGS. 6 and 7. In FIG. 6, the rusting index (in terms of rust area), with calcium in the range of 6–15 ppm, is plotted against the sulfur content in steel. The sulfur content in steel is closely related with rusting after cold rolling. In the case of cold rolled sheet containing calcium in the range of 6–15 ppm, it is necessary that the amount of sulfur in steel should be lower than 0.01 wt % if rusting is to be lower than the allowable level. In FIG. 7, the rusting index, with sulfur in the range of 0.005–0.009 wt. %, is plotted against the calcium content in steel. It is noted that the cold rolled sheet rusts in proportion to the amount of calcium. It is necessary that the amount of calcium should be lower than 20 ppm, preferably lower than 15 ppm, if rusting is to be lower than the allowable level.

Figure 8:
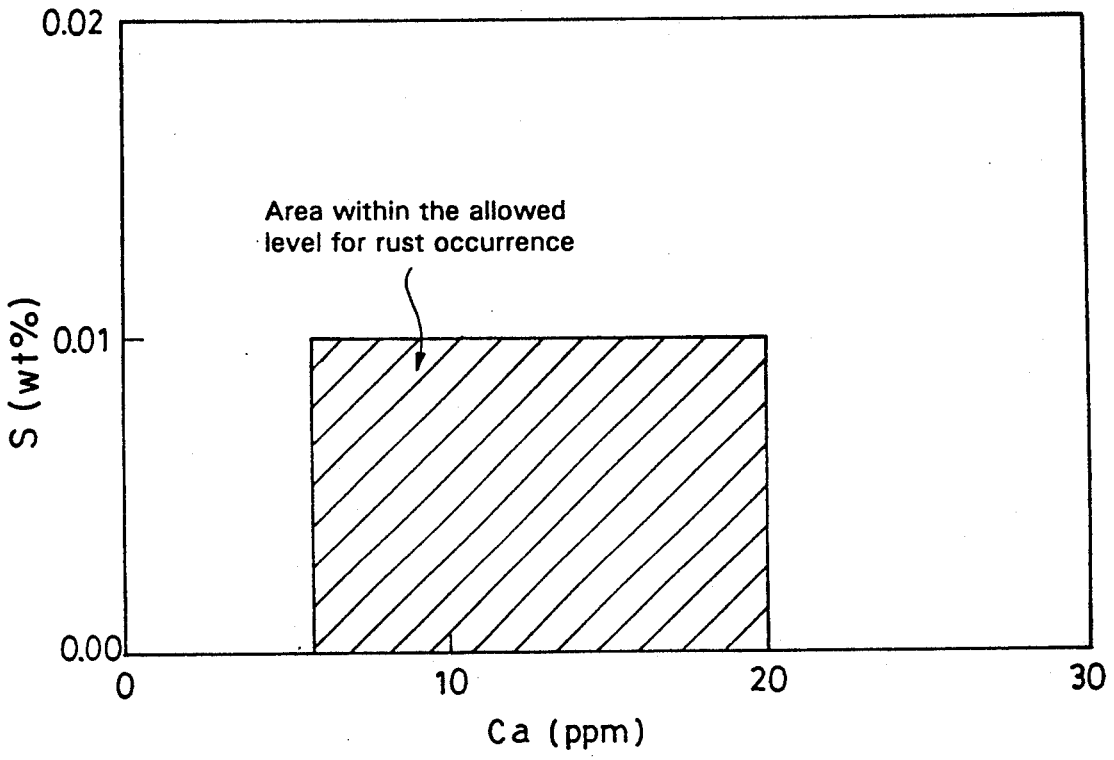
FIG. 8 is a diagram showing the area of the allowable level for rust occurrence which is determined by the calcium content and sulfur content.

The above-mentioned data and other data give FIG. 8 which shows the limits of calcium and sulfur contents within which it is possible to protect cold rolled sheets of ultra low carbon steel from rusting when the calcium content is in the range of 6–30 ppm and the sulfur content is in the range of 0.001–0.020 wt %. It is noted from FIG. 8 that the area for the allowable level of rusting is specified by $6 \text{ ppm} \leqq Ca \leqq 20$ ppm and $S \leqq 0.01$ wt %.

The above-mentioned experiments (A), (B), and (C) carried out by the present inventors revealed that the following five conditions are essential for the stable, continuous casting of ultra low carbon aluminum killed steel which is performed by the addition of calcium in the absence of gas blown into the immersion nozzle, if cold rolled steel sheets are to be made with minimum surface and internal defects and with a rusting level lower than the allowable limit.

(a) $6 \text{ ppm} \leqq Ca \leqq 20$ ppm (b) $S \leqq 0.01$ wt %

(c) $T.O \leqq 30$ ppm (d) $v \geqq 1.2$ m/sec (e) $\Delta T \geqq 16°$ C.

Incidentally, calcium to be added to the molten steel may be in the form of metallic calcium or Ca—Si alloy and so on, and the addition of calcium may be carried out while the molten steel is in the ladle or tundish.

BEST MODE FOR CARRYING OUT THE INVENTION

The invention will be described with reference to the following Examples and Comparative Examples.

Continuous casting of ultra low carbon aluminum killed steel was carried out with four charges of molten steel from the ladle under the conditions shown in Tables 3 and 4. In Comparative Example 2, casting was stopped due to nozzle clogging after casting of one or two heats.

TABLE 3

| Conditions of experiments in examples (1) | |
|---|---|
| Model of continuous casting machine | As shown in Table 1. |
| Mold size | 220 mm (t) × 1300 mm (W) |
| Molten steel throughput | 3.0 t/min |
| Molten steel superheat temperature (ΔT) in tundish | 23–27° C. |
| Immersion nozzle | As shown in Table 1. |
| Diameter of sliding nozzle | As shown in Table 1. |
| weight of molten steel in ladle | 140 tons/charge |
| Composition of molten steel | C . . . 16–26 ppm (20 ppm on average)<br>Si . . . tr.<br>Mn . . . 0.09–0.12 wt % (0.10 wt % on average)<br>P . . . 0.007–0.012 wt % (0.010 wt % on average)<br>Al . . . 0.036–0.043 wt % (0.040 wt % on average)<br>Ti . . . 0.024–0.030 wt % (0.026 wt % on average)<br>T · O . . . 19–25 ppm (22 ppm on average)<br>Ca and S (as shown in Table 4) |
| Blowing of argon gas into the immersion nozzle | As shown in Table 4. |

TABLE 4

| Conditions of experiments in examples (2) | | | |
|---|---|---|---|
| | Calcium content | Sulfur content | Blowing of gas into immersion nozzle |
| Example | 6–15 ppm | 0.004–0.008 wt % | none |
| Comparative | 6–15 ppm | 0.012–0.015 wt % | none |
| Example 1 Comparative | 2–5 ppm | 0.004–0.008 wt % | none |
| Example 2 Comparative Example 3 | not added | 0.004–0.008 wt % | Argon, 8Nl/min |

The ratio of nozzle opening area after casting, the occurrence of swelling in cold rolled sheets, and the area of rusting in the rusting test were examined. The results are shown in Table 5. The ratio of nozzle opening area is defined as a ratio (in percent) of the area of the discharge spout of the nozzle measured after casting to the area of the discharge spout of the nozzle measured before casting.

TABLE 5

| Results of experiments in examples | | | |
|---|---|---|---|
| | Ratio of nozzle opening area measured after casting (%) | Occurrence of swelling in cold rolled sheets (%) | Area of rust in the rusting test (%) |
| Example | 100 | 0.00 | 3.7 |
| Comparative Example 1 | 100 | 0.01 | 12.2 |
| Comparative Example 2 | 25 | 0.83 | 3.9 |
| Comparative Example 3 | 92 | 3.79 | 3.7 |

It is noted from Table 5 that according to the present invention it is possible to solve the problems associated with nozzle clogging at the time of casting and swelling at the time of annealing cold rolled sheets and it is also possible to considerably suppress the rusting of cold rolled sheets.

We claim:

1. In a process for continuous casting of ultra low carbon aluminum killed steel, wherein said steel is caused to flow from a tundish through a nozzle which includes a straight portion, and wherein said steel contains 6–20 ppm of calcium, less than 0.01 wt. % of sulfur, and less than 30 ppm of oxygen, the steps which comprise providing a molten steel superheat temperature in the tundish which is higher than 16° C., and providing an average flow rate of molten steel which is greater than 1.2 m/sec in the straight portion of the nozzle.

2. A process for continuous casting of ultra low carbon aluminum killed steel as defined in claim 1, wherein the process is carried out without blowing a gas into the immersion nozzle.

* * * * *